US008283540B2

(12) United States Patent
Slater

(10) Patent No.: US 8,283,540 B2
(45) Date of Patent: Oct. 9, 2012

(54) MUSICAL INSTRUMENT TUNING APPARATUS AND METHOD

(76) Inventor: Benita H. Slater, Germantown, MD (US)

( * ) Notice: Subject to any disclaimer, the term of this patent is extended or adjusted under 35 U.S.C. 154(b) by 38 days.

(21) Appl. No.: 12/972,474

(22) Filed: Dec. 19, 2010

(65) Prior Publication Data

US 2012/0152086 A1 Jun. 21, 2012

(51) Int. Cl.
*G10D 7/00* (2006.01)

(52) U.S. Cl. ..... 84/380 R; 84/399

(58) Field of Classification Search ..... 84/380 R, 84/399

See application file for complete search history.

(56) References Cited

U.S. PATENT DOCUMENTS 5,249,499 A * 10/1993 Goldstein et al. ..... 84/386

* cited by examiner

*Primary Examiner* — Jianchun Qin
(74) *Attorney, Agent, or Firm* — Womble Carlyle

(57) ABSTRACT

A musical instrument tuning device includes a tuning sleeve and a tuning collar threadingly engaged to the tuning sleeve. The apparatus is mountable onto a first portion of a musical instrument which also has a second portion, the second portion being slidingly adjustable relative to the first portion to change the length of an air passage to tune that musical instrument. In one embodiment, the musical instrument tuning device is mounted on a neck portion of a saxophone to which a mouthpiece is typically engaged. Rotation of the tuning collar moves a saxophone mouthpiece relative to the neck portion and thereby enables a musician to quickly and precisely tune the saxophone.

19 Claims, 2 Drawing Sheets

MUSICAL INSTRUMENT TUNING APPARATUS AND METHOD

FIELD OF THE INVENTION

The present invention relates to a method and apparatus for use with a musical instrument having two portions which are adjusted relative to one another to change the length of an air passage to tune that musical instrument. In one embodiment, the invention relates to a rotatable adjustment apparatus that allows a musician to make precise adjustments to the tuning components of a reed-type musical instrument such as a saxophone.

BACKGROUND OF THE INVENTION

Tuning an instrument is a necessary and important prerequisite to any instrumental performance. Many instruments are tuned by adjusting the position of the instrument's mouthpiece, slides, or other extendable and retractable tuning components. In the case of a saxophone (for example) this is accomplished by sliding the mouthpiece forward or backward along a corresponding cork-covered section of a neck portion of the saxophone until the proper pitch is achieved. As is known to those skilled in the art, the cork-covered section is gently conically tapered to form a frictional fit with the mouthpiece, upon pressing the mouthpiece onto the cork-covered section.

However, since the saxophone mouthpiece fits snugly on the saxophone's neck portion, it is often difficult to precisely position the mouthpiece and thereby acquire the desired pitch setting. Frequently when a musician attempts to tune a saxophone he pushes the mouthpiece in too far, and then attempts to correct the mouthpiece's position by pulling the mouthpiece out too far. This iterative process can continue indefinitely and is particularly frustrating for new saxophone players who are not familiar with the instrument and the tuning process.

Further, for the saxophone to play properly, a musician must continuously moisten the saxophone mouthpiece with saliva. As discussed supra, conventionally tuning a saxophone requires the musician to grasp the mouthpiece and push it in or pull it out. It is not unusual for the musician to get saliva on his hands during the tuning process. Although this is unpleasant for a musician tuning his own instrument, it is particularly unpleasant (and potentially a means for spreading disease) when (for example) a band teacher is attempting to assist multiple new saxophone students.

The need exists for a tuning method and apparatus that makes the process of tuning and instrument easier, more precise, and more sanitary. The current invention comprises a method and apparatus whereby a musician adjusts a screw-type tuning collar to position an adjustable portion of an instrument to thereby quickly and effectively tune the instrument.

SUMMARY OF THE INVENTION

The current invention is directed to a musical instrument tuning apparatus for tuning a musical instrument having a first portion and a second portion which are movable relative to one another to adjust a length of an air passage of that musical instrument and thereby tune the musical instrument.

In one embodiment the musical instrument comprises a saxophone having a neck portion ("first portion") and a mouthpiece ("second portion") moved relative to the neck portion to change a length of an air passage of the saxophone, to thereby tune the saxophone. The tuning apparatus includes a threaded tuning sleeve and a corresponding tuning collar. The tuning sleeve slides onto the neck portion of a saxophone and the tuning collar engages the tuning sleeve. The musician then slides the saxophone mouthpiece onto the neck portion of the saxophone until the mouthpiece abuts the tuning collar. The musician tunes the saxophone by adjusting the tuning collar until the instrument is successfully tuned.

DETAILED DESCRIPTION OF PREFERRED EMBODIMENTS

The present invention comprises a musical instrument tuning apparatus. In the preferred embodiment, the instrument comprises a saxophone, however other instruments should be considered within the scope of the invention so long as they have a first portion which is adjustable relative to a second portion to thereby change a length of an air passage to tune the instrument.

Figure 1:
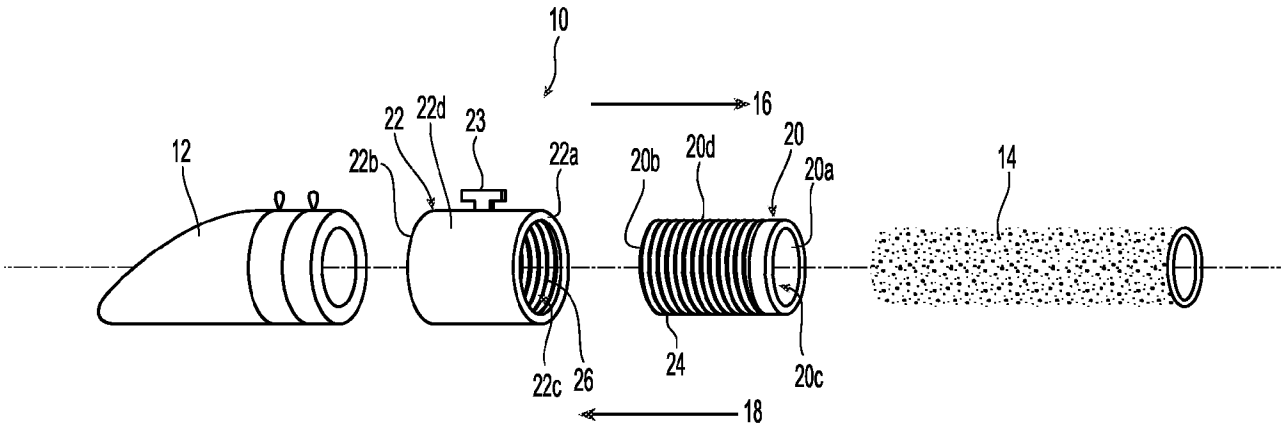
FIG. 1 is an exploded perspective view of the tuning apparatus of the current invention.

FIG. 1 generally shows an exploded view of the musical instrument tuning apparatus 10 as well as other affected traditional saxophone components. Conventionally, a user slides a saxophone mouthpiece 12 directly onto the cone-shaped cork-covered section belonging to a neck portion 14 ("mounting portion") of a saxophone. To tune the saxophone, the musician plays a tone and then adjusts the position of the saxophone mouthpiece 12 in the direction of the arrow 16 to make the tone sharper, and in the direction of the arrow 18 to flatten the tone. The musician continues this iterative process until he is satisfied that the instrument is in tune.

In one embodiment, the musical instrument tuning apparatus 10 of the current invention functions as a musical instrument mouthpiece positioning apparatus. The musical instrument tuning apparatus 10 includes a tubular tuning sleeve 20 and a tubular tuning collar 22. The tuning sleeve has a first sleeve end 20*a*, a second sleeve end 20*b*, a sleeve inner surface 20*c* and a sleeve outer surface 20*d* having a first thread 24. In one embodiment, the inner surface 20*c* of the tuning sleeve 20 is smooth. The tuning collar has a first collar end 22*a*, a second collar end 22*b*, a threaded collar inner surface 22*c* and a collar outer surface 22*d* having a second thread 26. The first thread 24 and the second thread 26 are configured to threadingly engage one another, upon screwing. The second collar end 22*b* comprises an abutment surface, which in one embodiment is ring-shaped.

Figure 2:
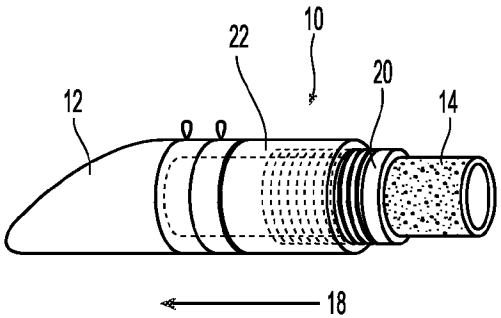
FIG. 2 is a perspective view of the tuning apparatus prior to the initiation of the tuning process.

In accordance with one embodiment, the musician first removes the conventional mouthpiece 12 from the saxophone neck portion 14. Then the musician slides the tuning sleeve 20 over the neck portion 14, which serves as a mounting portion, until the leading end of the cone-shaped cork-covered section of the neck portion 14 protrudes from the second end 20*b* of the tuning sleeve 20. In one embodiment, the tuning sleeve's inner surface 20*c* is sized such that it is frictionally retained by the cork-covered section, upon sliding therealong for a predetermined distance. This leaves some of the cork-covered section exposed so that one may still mount the mouthpiece 12 thereon. Thus, like the mouthpiece 12, the tuning sleeve 20 is sized to fit snugly on the saxophone neck portion 14. Also, musician purposely positions the tuning sleeve 20 slightly further up the neck portion 14 of the saxophone than the approximate "tuned" position of the mouthpiece 12. The musician then screws the internally threaded tuning collar 22 onto the tuning sleeve 20. Next, the musician slides the mouthpiece 12 onto the neck portion 14 until the distal end of mouthpiece 12 abuts the tuning collar 22, such as at the latter's second collar end 22*b*. FIG. 2 shows the tuning apparatus 10 in this assembled but "un-tuned" configuration. As shown in phantom, the leading end of the cork-covered section protrudes through the tuning sleeve 20.

Figure 3:
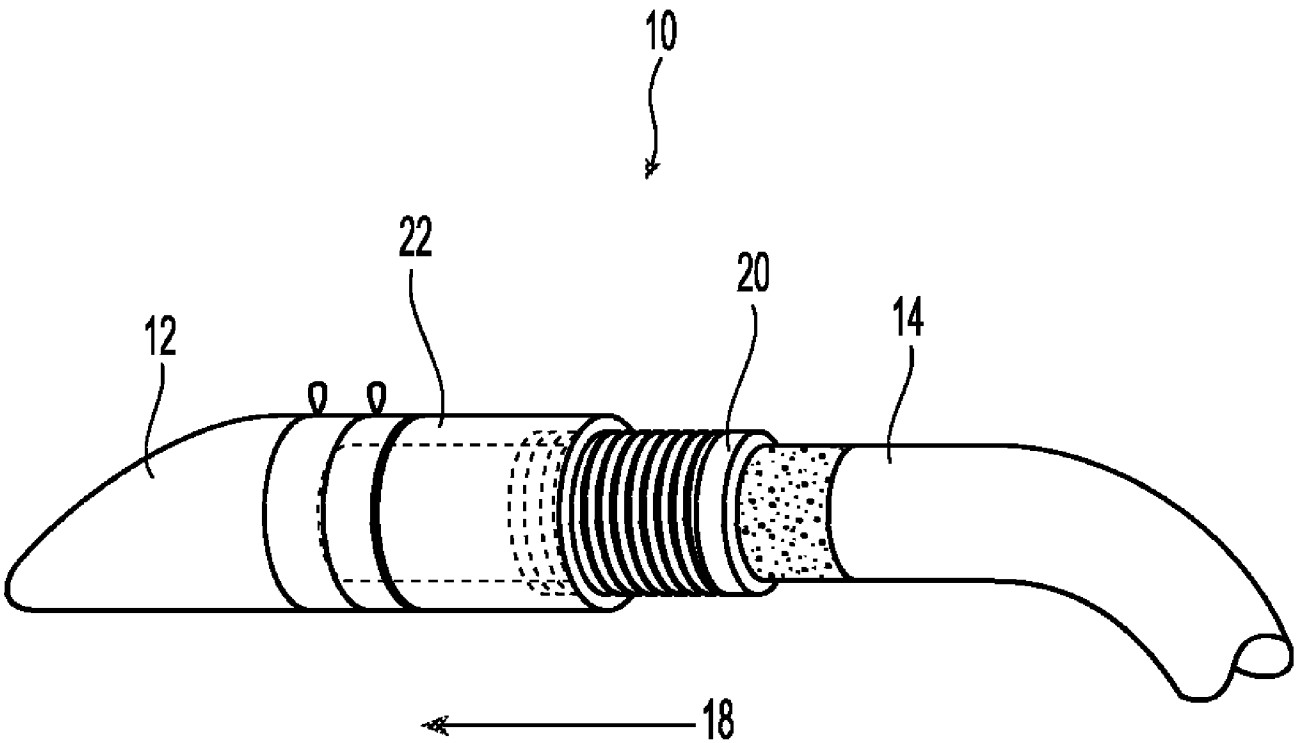
FIG. 3 is a side view of the tuning apparatus showing the apparatus in an adjusted (tuned) position.

Once the tuning apparatus 10 is assembled, the musician adjusts the position of the mouthpiece 12 by rotating the tuning collar 22 (preferably) in the counter-clockwise direction, thereby causing the tuning collar 22 to move gradually in the direction of the arrow 18. The tuning collar 22 may have a finger-actuated adjustment portion 23, such as a protrusion, textured surface or one or more a recesses formed on the collar outer surface 22*d* to facilitate rotation of the tuning collar 22. As the tuning collar 22 moves in the direction of the arrow 18, it gradually pushes the saxophone mouthpiece 12 in the direction of the arrow 18. This process continues until the saxophone mouthpiece reaches the "tuned" configuration shown in FIG. 3. As shown in phantom, even in the tuned configuration, the leading end of the cork-covered section still protrudes through the tuning sleeve 20.

In operation, to tune a saxophone using the tuning apparatus 10 of the current invention, a musician first assembles the tuning apparatus 10 on the saxophone so that the components are generally positioned as shown in FIG. 2. Note that the initial positions of the musical instrument tuning apparatus 10 and the mouthpiece 12 are further up the neck portion of the saxophone than the usual tuned position. Based on the musician's experience (or the instructions of his teacher), the musician knows that in this position, the saxophone will initially have a sharp tone.

Once the musical instrument tuning apparatus is in place, a musician plays an initial tone and, based on the tone, starts to rotate the tuning collar 22 so that the tuning collar gradually slides the mouthpiece 12 in the direction of the arrow 18. The musician continues to adjust the tuning collar 22 until the instrument is successfully tuned.

The musical instrument tuning apparatus 10 may be used with all conventional saxophones and mouthpieces so that no additional hardware (other than the tuning apparatus 10) is required.

In the embodiment described above, the rotation of the tuning collar in a first direction pushes the mouthpiece in the direction of arrow 18 to increase the length of an air passage while rotation of the tuning collar in a second direction opposite the first direction has no effect on either the position of the mouthpiece or on the length of the air passage. In another embodiment, instead of simply abutting and pushing the mouthpiece 12 only in the direction of arrow 18, the tuning collar 22 may be coupled to mouthpiece 12 in some manner so that the mouthpiece 12 may be selectively adjusted in the direction of either arrow 18 or arrow 16, depending on the direction of rotation of the tuning collar 22.

In such a "bi-directional" positioning apparatus, the second end 22*b* of the tuning collar 22 may be provided with a swivel joint that is coupled to the mouthpiece 12. The tuning collar 22 can then rotated without causing the mouthpiece 12 to also rotate therewith. Instead, rotation of the tuning collar 22 in either rotational direction causes the mouthpiece to translate in an associated direction. For instance, when the musician rotates the tuning collar 22 clockwise, the mouthpiece 12 may move forward in the direction of the arrow 16, whereas when the musician rotates the collar 22 counter-clockwise, the mouthpiece may move in the rearward in the direction of the arrow 18.

For the foregoing reasons, it is clear that the invention provides an innovative saxophone tuning apparatus.

The current invention may be modified in multiple ways and applied in to various instruments. For example, the current invention could be adapted to be used on instruments with slide-type tuning configurations, such as brass instruments including trumpets, trombones, tubas, and the like, so long as they have a first portion that is adjustable relative to a second portion to thereby change a length of an air passage to tune the instrument.

Furthermore, a musical instrument, such as a saxophone, may have a neck portion already provided with an external thread. The external thread may be integrally formed to have one-piece construction with the neck portion, or may be fixedly mounted thereto. In either case, an appropriately sized tuning collar may be provided to threadingly engage the external thread. It is understood that the manufacturer or seller of the musical instrument will generally provide a tuning collar matched to the threaded portion at the time the musical instrument is provided.

The current invention may also be customized as required by a specific operation or application, and the individual components may be modified and defined, as required, to achieve a desired result. Although some of the materials of construction are not explicitly described, they may include a variety of compositions consistent with the function of the invention. Such variations are not to be regarded as a departure from the spirit and scope of the invention, and all such modifications as would be obvious to one skilled in the art are intended to be included within the scope of the following claims.

What is claimed is:

1. A musical instrument tuning apparatus capable of slidingly adjusting a position of a first portion of a musical instrument relative to a second portion of said musical instrument to thereby increase a length of an air passage of said musical instrument, the positioning apparatus comprising:

a tuning sleeve having a first sleeve end, a second sleeve end, a sleeve inner surface and a sleeve outer surface, the sleeve inner surface configured to fit over a first portion of a musical instrument with part of the first portion protruding through the tuning sleeve, the sleeve outer surface having a first thread;

a tuning collar having a first collar end, a second collar end, a collar inner surface and a collar outer surface, the collar inner surface having a second thread configured to threadingly engage the first thread belonging to the sleeve outer surface, the first collar end configured to abut a second portion of said musical instrument when said second portion is slidably mounted on said part of the first portion; wherein:

when the tuning apparatus and second portion are mounted on the first portion of the musical instrument with the first collar end in abutment with the second portion, upon rotation of the tuning collar in a first direction, the tuning collar is configured to travel relative to the tuning sleeve and urge the second portion in a direction away from the tuning sleeve, to thereby change a pitch of the musical instrument, and said second portion remains in position on said part of the first portion and the length of the air passage remains unchanged upon rotation of the tuning collar in a second direction opposite to the first direction.

2. The musical instrument tuning apparatus accordingly to claim 1, wherein:

the first portion of the musical instrument is a neck portion of the saxophone;

the second portion of the musical instrument is a mouthpiece of the saxophone; and the tuning apparatus is configured to adjust a position of the mouthpiece relative to the next portion and thereby adjust a length of an air passage formed by the mouthpiece and neck portion.

3. The musical instrument tuning apparatus of claim 2, wherein the tuning collar further comprises a finger-actuated adjustment portion.

4. The musical instrument tuning apparatus of claim 2, wherein the tuning collar is independent of the mouthpiece so that rotating the tuning collar does not rotate the mouthpiece.

5. A saxophone tuning apparatus for a saxophone having a mouthpiece that is slidable relative to a neck portion thereof, comprising:

a tuning sleeve mountable on a neck portion of a saxophone such that part of the neck portion protrudes through the tuning sleeve; and a tuning collar engageable to the tuning sleeve;

wherein rotation of the tuning collar in a first direction changes a position of the mouthpiece relative to the neck portion, thereby increasing a length of an air passage to change a pitch of the saxophone, when the tuning sleeve is mounted on said neck portion, the mouthpiece is slidably mounted on said part of the neck portion and the tuning collar is operatively engaged to said tuning sleeve and to said mouthpiece.

6. The saxophone tuning apparatus of claim 5, wherein:

an outer surface of the tuning sleeve is provided with a first thread;

an inner surface of the tuning collar is provided with a second thread;

the tuning collar is configured to abut the mouthpiece; and rotation of the tuning collar moves the mouthpiece and changes the pitch of the saxophone.

7. The saxophone tuning apparatus of 5, wherein the tuning collar further comprises a finger-actuated adjustment portion.

8. A musical instrument in combination with a musical instrument mouthpiece positioning apparatus, the musical instrument comprising a mouthpiece slidable relative to a mounting portion of the musical instrument, the musical instrument mouthpiece positioning apparatus comprising a tuning sleeve and a tuning collar, wherein:

the tuning sleeve is positioned on the mounting portion with part of the mounting portion protruding through the tuning sleeve;

the tuning collar is engaged to the tuning sleeve;

the mouthpiece is slidably mounted on said part of the mounting portion and in abutment with the tuning collar;

rotation of the tuning collar in a first direction changes a position of the mouthpiece relative to the mounting portion and thereby increases a length of an air passage to change a pitch of the musical instrument; and the mouthpiece remains in position on said part of the mounting portion and the length of the air passage remains unchanged, upon rotation of the tuning collar in a second direction opposite to the first direction.

9. The combination of claim 8, wherein the tuning collar further comprises a finger-actuated adjustment portion.

10. The combination of claim 8, wherein the tuning collar is independent of the mouthpiece so that rotating the tuning collar does not rotate the mouthpiece.

11. The combination of claim 8, wherein the tuning sleeve slidably engages the mounting portion.

12. The combination of claim 8, wherein:

the tuning sleeve comprises a smooth inner surface and a threaded outer surface; and the tuning collar comprises a threaded inner surface.

13. The combination of claim 8, wherein, in an un-tuned position, the mouthpiece abuts the tuning collar.

14. The combination of claim 8, wherein in a tuned position the mouthpiece abuts the tuning collar.

15. The combination of claim 8, wherein the pitch of the instrument is changed by rotating the collar so that the collar moves along the mounting portion in the direction of the mouthpiece.

16. A method of tuning a musical instrument comprising a mouthpiece connectable to a mounting portion of the musical instrument, the method comprising:

mounting a tuning sleeve onto the mounting portion such that part of the mounting portion protrudes through the tuning sleeve;

threadingly mounting a tuning collar onto the tuning sleeve;

slidably mounting a mouthpiece on said part of the mounting portion and in abutment with the tuning collar; and rotating the tuning collar in a first direction to thereby change a position of the mouthpiece relative to the mounting portion and increase a length of an air passage and change a pitch of the musical instrument;

wherein the mouthpiece remains in position on said part of the mounting portion and the length of the air passage remains unchanged, upon rotation of the tuning collar in a second direction opposite to the first direction.

17. The method of claim 16, comprising:

rotating the tuning collar to thereby change a position of the mouthpiece relative to the mounting portion.

18. A method of tuning a musical instrument comprising a mouthpiece connectable to a mounting portion of the musical instrument, the mounting portion having an external thread associated therewith, the method comprising:

threadingly mounting a tuning collar onto the external thread;

slidably mounting a mouthpiece on at least a part of the mounting portion and in abutment with the tuning collar; and rotating the tuning collar in a first direction to thereby change a position of the mouthpiece relative to the mounting portion and increase a length of an air passage and change a pitch of the musical instrument, wherein the mouthpiece remains in position on said part of the mounting portion and the length of the air passage remains unchanged, upon rotating the tuning collar in a second direction opposite to the first direction.

19. The method of claim 18, comprising:

rotating the tuning collar to thereby change a position of the mouthpiece relative to the mounting portion.

* * * * *